United States Patent [19]

Wilson

[11] Patent Number: 4,651,825

[45] Date of Patent: Mar. 24, 1987

[54] ENHANCED WELL PRODUCTION

[75] Inventor: Robert Wilson, Plano, Tex.

[73] Assignee: Atlantic Richfield Company, Los Angeles, Calif.

[21] Appl. No.: 861,177

[22] Filed: May 9, 1986

[51] Int. Cl.[4] ..... E21B 43/24

[52] U.S. Cl. ..... 166/245; 166/248; 166/272; 166/65.1

[58] Field of Search ..... 166/245, 248, 272, 60, 166/65.1

[56] References Cited

U.S. PATENT DOCUMENTS

| | | | |
|---|---|---|---|
| 3,220,942 | 11/1965 | Crites | 166/65.1 |
| 3,507,330 | 4/1970 | Gill | 166/248 |
| 3,547,193 | 12/1970 | Gill | 166/248 |
| 3,620,300 | 11/1971 | Crowson | 166/248 |
| 3,782,465 | 1/1974 | Bell et al. | 166/248 |
| 4,199,025 | 4/1980 | Carpenter | 166/248 |
| 4,280,558 | 7/1981 | Bodine | 166/245 |
| 4,396,062 | 8/1983 | Iskander | 166/248 |
| 4,444,255 | 4/1984 | Geoffrey et al. | 166/65.1 X |
| 4,545,435 | 10/1985 | Bridges et al. | 166/248 |

*Primary Examiner*—George A. Suchfield
*Attorney, Agent, or Firm*—Roderick W. MacDonald

[57] ABSTRACT

A method and apparatus for enhancing the production of a hydrocarbonaceous fluid from a subterranean geologic reservoir containing same using electrical heating by employing at least three electrodes between the injection wellbore and production wellbore and passing electricity only between the three electrodes.

10 Claims, 5 Drawing Figures

ENHANCED WELL PRODUCTION

BACKGROUND OF THE INVENTION

Heretofore in the electrical stimulation of a hydrocarbonaceous bearing reservoir, such as an oil bearing reservoir, two wellbores have been established in the reservoir. One of the wellbores is an injection wellbore for passage of a motivating fluid such as water, steam, and the like into the reservoir. Spaced therefrom is a production wellbore for receiving mobilized oil and transferring same from the reservoir to the earth's surface for recovery. The fluid injected by way of the injection wellbore pushes oil toward the production reservoir for more efficient recovery of oil from the reservoir in the space between the injection and production wells. Electrical heating has heretofore been employed between injection and production wellbores by making those wellbores the electrode wellbores as well. This way the electricity entered the reservoir at the injection wellbore and passed to the production wellbore.

By this approach, it has been observed that in a region roughly midway between the injection production wellbores, significant heating is not obtained in many cases, whereas excessive heating is experienced in regions immediately adjacent the injection and production wellbores. Because of excessive heating adjacent to the injection and production wellbores, any water present becomes steam, which interferes with electrical conduction through the reservoir and thereby reduces electrical heating in the reservoir due to gas blocking.

BRIEF SUMMARY OF THE INVENTION

In accordance with this invention, there is provided a method and apparatus whereby substantial electrical heating can be accomplished throughout the mid-region between injection and production wellbores, and heating caused by the introduction of electricity into the reservoir immediately adjacent the injection and production wellbores is essentially eliminated.

In accordance with this invention, there is provided a method and apparatus for electrical heating of a reservoir region between an injection wellbore and a production wellbore, wherein at least one first electrode wellbore is employed in the reservoir intermediate to the injection and production wellbores, and other electrode wellbores are emplaced in the reservoir intermediate to the injection wellbore and the first electrode wellbore, and intermediate to the production wellbore and the first electrode wellbore. Electricity is then passed between only the electrode wellbores and not the injection and production wellbores, thereby assuring good heating of the reservoir in the mid-region between the injection and production wellbores but not immediately adjacent to the injection or production wellbores themselves.

Accordingly, it is an object of this invention to provide a new and improved method and apparatus for enhanced well production using electrical preheating. Another object is to provide a new and improved method and apparatus for electrically heating a subterranean geologic formation between an injection and production wellbore without incurring excessive heating adjacent the injection or production wellbores.

Other aspects, objects and advantages of this invention will be apparent to those skilled in the art from this disclosure and the appended claims.

DETAILED DESCRIPTION OF THE INVENTION

In accordance with this invention, there is provided a method and apparatus for enhancing the production of hydrocarbonaceous fluid from a subterranean reservoir containing same by electrical heating of the reservoir between an injection wellbore and a production wellbore. There is employed at least one first electrode in the reservoir intermediate the injection and production wellbores. There is also employed at least one second electrode in the reservoir intermediate the injection wellbore and the at least one first electrode, and at least one third electrode in the reservoir intermediate the production wellbore and the at least one first electrode. Thereafter, an electrical current is passed from the at least one first electrode through the reservoir to the at least one second and third electrodes to thereby electrically heat the reservoir in the region between the second and third electrodes, and to ensure good electrical heating in the mid-region between the injection and production wellbores. At the same time electrical heating is kept away from a finite region immediately adjacent the injection and production wellbores.

Figure 1:
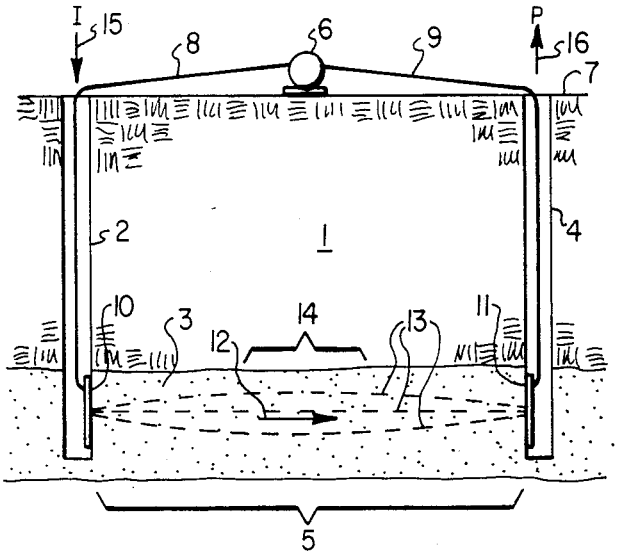
FIG. 1(PRIOR ART)
FIG. 1 shows a vertical cross section of a prior art injection and production wellbore which system employs injection and production wellbores as electrode wellbores.

More particularly, FIG. 1 shows a prior art construction wherein the earth 1 has an injection wellbore 2 drilled down to and into subterranean formation reservoir 3. A production wellbore 4 is drilled into earth 1 and reservoir 3 in the same manner as injection well 2 but spaced a substantial distance from a well 2 so that a substantial portion 5 of reservoir 3 is between wells 2 and 4. In the prior art approach, an electrical generator 6 sitting on earth's surface 7 was electrically connected by way of wires 8 and 9 to an electrode 10 in wellbore 2 and an electrode 11 in wellbore 4. Wires 8 and 9 were electrically insulated so that the electricity entered only reservoir 3 by way of electrodes 10 and 11, which were physically in contact with reservoir 3 and not in contact with formations of earth 1 above or below reservoir 3. In this way, a flow of electricity from injection well 2 to production well 4 was established as shown by arrow 12. Because of the theoretical uniform flow of electricity throughout the reservoir, as indicated by dotted lines 13, the entirety of area 5 of reservoir 3 between wellbores 2 and 4 should be heated. However, as has been indicated before, observations of actual experiments as shown in FIG. 1 indicate that in many cases very little heating occurs in a mid-region 14 of reservoir 3 and, further, that excessive heating can occur adjacent at wellbores 10 and 11 when those wellbores are used as electrodes as well as injection and production wellbores.

For sake of completeness, in one prior art approach, after electricity has been passed from wellbore 2 to wellbore 4 by way of electrodes 10 and 11 for a sufficient period of time to heat a portion of reservoir 3, and thereby render some oil therein more mobile, a drive fluid such as water or steam, is injected into wellbore 2 as shown by arrow 15 to enter reservoir 3 in the vicinity of electrode 10 and thereby move as indicated by arrow 12 through reservoir 3 toward wellbore 4. This forces the electrically mobilized oil ahead of the drive fluid production wellbore 4 so that that oil can be recovered at earth's surface 7 as indicated by arrow 16 for transportation, refining, and other disposition as desired.

Figure 2:
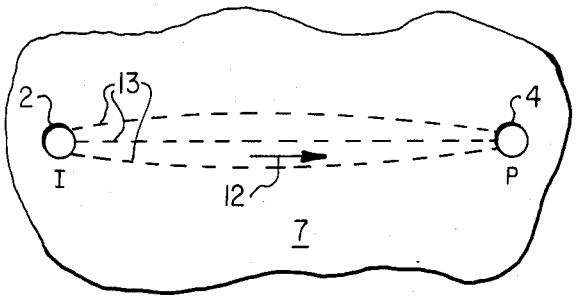
FIG. 2(PRIOR ART)
FIG. 2 is a top view of the prior art well configuration of FIG. 1.

FIG. 2 shows a top view of FIG. 1, with electrical generator 6 and wires 8 and 9 eliminated for sake of simplicity, to show that the flow of electricity as indicated by dotted lines 13 have lateral as well as vertical extent when serving to mobilize oil in reservoir 3.

Figure 4:
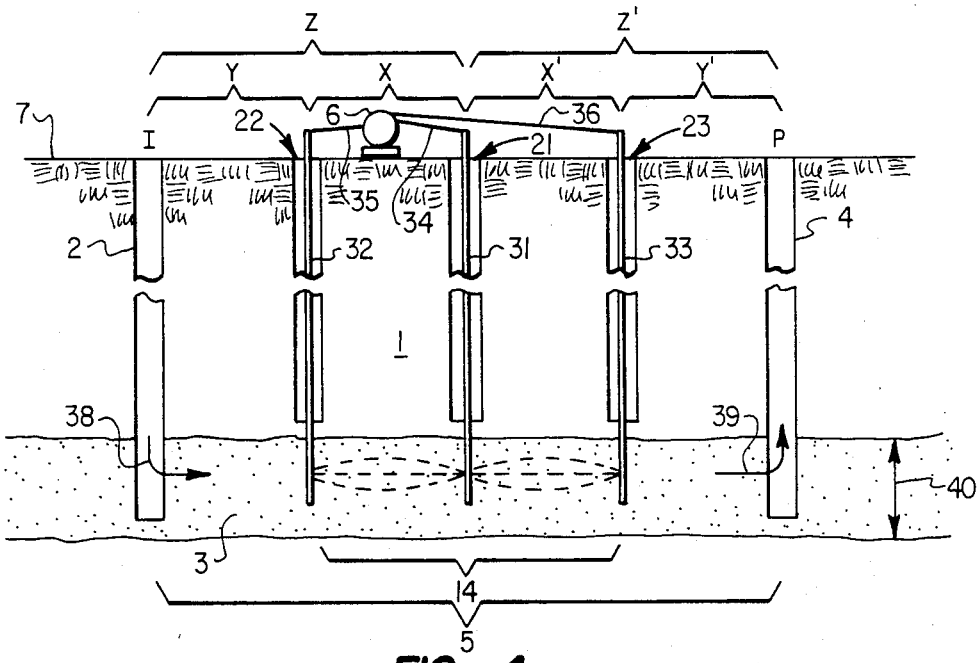
FIG. 4 shows a vertical cross sectional view of the embodiment of FIG. 3.
Figure 3:
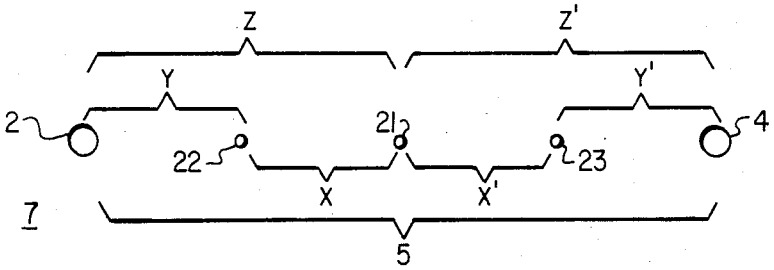
FIG. 3 is a top view of a well configuration employing one embodiment of this invention.

FIG. 3 shows a top view of a well configuraton embodiment within this invention which employs injection wellbore 2 and production wellbore 4 but does not use either of these wellbores as an electrode wellbore. Instead, in accordance with this invention there is employed at least one first electrode wellbore 21 whose electrode 31 extends into reservoir 3, as shown in FIG. 4, intermediate injection well 2 and production well 4. At least one second electrode wellbore 22 is employed whose electrode 32 extends into reservoir 3 and which is disposed intermediate injection well 2 and first electrode wellbore 21. There is additionally employed at least one third electrode wellbore 23 whose electrode 33 also extends into reservoir 3 and which is disposed intermediate production well 4 and first electrode wellbore 21. Thus, a plurality of electrode wellbores with electrodes in electrical connection with reservoir 3 are established intermediate wells 2 and 4 so that mid-region 14 is amply bracketed with electrodes but yet outer electrode wellbores 22 and 23 are spaced a finite distance away from wells 2 and 4.

The actual spacing between adjacent wellbores shown in FIG. 3 can vary widely and the benefits of this invention still obtained. Although a plurality of separate electrode wellbores can be employed instead of single wellbores 21, 22, and 23, and this plurality of wellbores can be arranged in any geometrical configuration desired, for sake of simplicity, hereafter each wellbore will be referred to as a single wellbore. However, it is to be understood that this invention encompasses using a plurality of wellbores at each wellbore location shown, and particularly for any or all of the electrode wellbore locations. As to the relative spacing of electrode wellbores in relation to themselves and the injection and production wellbores, first electrode wellbore 21 clearly must be spaced away from the injection and production wellbores, and preferably is located somewhere in mid-region 14. Generally, injection wellbore 21 will be spaced from both injection wellbore 2 and production wellbore 4 a distance which is at least as great as about one-third of the total distance 5 between wellbores 2 and 4. This distance is represented in FIG. 3 as Z for wellbores 2 and 21, a Z' for wellbores 4 and 21. Distances Z and Z' need not be equal but can be different in magnitude so long as each is at least about one-third of distance 5.

Second electrode wellbore 22 should be spaced intermediate wellbore 2 and electrode wellbore 21. Distance Y which is the spacing between injection wellbore 2 and second electrode wellbore 22, and Y must be a finite distance but should not be greater than about one-fourth of the total distance 5 between injection well 2 and production well 4. Thus, second electrode wellbore 22 may or may not be within mid-region 14. Wellbore 22 is preferably a distance of at least about ten feet from injection wellbore 2. The same applies to space Y' between third electrode wellbore 22 and production well 4, i.e., a finite distance but not greater than about one-fourth of the total distance 5 and preferably at least about ten feet away from wellbore 4. Wellbore 21 is spaced intermediate wellbores 22 and 23 and spaced from both wellbores 22 and 23 distances X and X' which distances may vary widely and need not be equal. Distance X can vary from about one-fourth to about three-fourths of the sum of distances X and X', with distance X' making up the remainder of the sum.

It is to be understood that the number of wellbores employed for said first, second, and third electrode wellbores, the configuration, alignment and spacing of the plurality of wellbores and the relative spacing between the first, second, and third electrode wellbores (whether a single or plurality of wellbores is employed) will vary widely depending upon the particular characteristics of reservoir 3 itself, the type of oil and other fluids contained in the reservoir, the presence or absence of other materials such as natural gas with its concurrent pressurization, the topography of earth's surface 1, the depth of reservoir 3 below earth's surface 1 and on and on, so that the number of wells and the arrangement of those wellbores, particularly the electrode wellbores will vary widely. It is to be understood that the advantages of this invention can be obtained within a wide range of wellbore numbers, alignments, and arrangements so long as the basic principle of this invention is followed of at least three electrode wellbores intermediate the injection of production wellbores with the first electrode wellbore intermediate the second and third electrode wellbores and passing electricity between the first electrode wellbore and the second and third electrode wellbores.

FIG. 4 shows a cross sectional elevation of the embodiment of FIG. 3 which further shows that electrode wellbores 21, 22, and 23 contain an electrode 31, 32, and 33, respectively, which is driven into or otherwise connected wih formation 3 to establish electrical contact with that formation and which is spaced from the outer walls of the wellbores so that electrical contact is made only in formation 3 and not anywhere along the length of the wellbore itself. Electrical generator 6 is then connected by wires 34, 35, and 36 to complete the electrical circuit. Generator 6 is preferably operated so that electricity passes by way of wire 34 through electrode 31 so that electricity first enters formation 3 at the point where electrode 31 is emplaced in formation 3. This way electricity flows from electrode 31 towards electrodes 32 and 33 thereby heating formation 3 between electrodes 32 and 33, i.e., in midregion 14. It should be appreciated that by placement of electrodes 32 and 33 closer to wellbores 2 and 4, heating of a region broader than a mid-region 14 can be accomplished, and this is within the scope of this invention, so long as electrodes 32 and 33 are not placed so close to wellbores 2 and 4 that excessive heating in the region immediately adjacent wellbores 2 and 4 is experienced as explained above in relation to FIG. 1 and the prior art operation.

After reservoir 3 has been adequately preheated by electrical means using electrodes 31 through 33, electrical heating can be continued or terminated as desired, and a drive fluid injected by way of wellbore 2 as shown by arrow 38. The fluid will flow through 3 toward production well 4 to push the electrically preheated oil out of reservoir 3 toward well 4 for recovery in well 4 as shown by arrow 39 for productin to the earth's surface 7 and subsequent disposition from there.

Depending upon the characteristics of reservoir 3, the oil therein, and numerous other parameters, it may be desirable to heat the full vertical height 40 of reservoir 3 or only a portion thereof, e.g., an upper portion, lower portion, etc. This can be controlled in many ways, such as by controlling the depth to which electrodes 31 through 33 extend into reservoir 3. For example, as shown in FIG. 4, electrodes 31 through 33 extend only down to about a mid point of reservoir 3 thereby preferentially heating primarily only an upper portion of reservoir 3.

Figure 5:
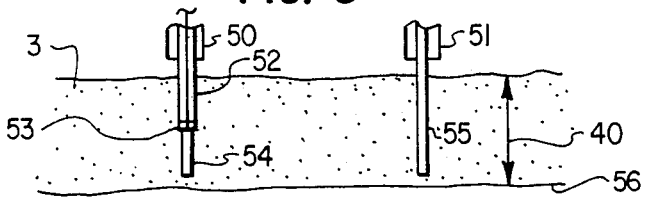
FIG. 5 shows various configurations for emplacing electrodes in the reservoir that is to be electrically heated.

As shown in FIG. 5, other means can be employed to heat various portions of reservoir 3. For example, in FIG. 5 wellbore 51 contains electrode 55, which extends essentially all the way to the bottom 56 of reservoir 3. This configuration would tend to heat the full height 40 of reservoir 3. However, if desired, only the bottom half of reservoir 3 could be heated by using wellbore 50, insulated conductor 52, and exposed electrode 54, line 53 indicating the point where insulated conductor 52 stops and uninsulated electrode 54 starts so that the exposed portion 54 tends to heat only the lower portion of reservoir 3. It should be noted that the electrode depth in reservoir 3 need not be the same for all of electrodes 31 through 33. For example, the electrodes could be employed all in an upper portion in the reservoir as shown in FIG. 4, but this is not required. The electrodes could all be employed for the full height 40 of reservoir 3 as shown for electrode 55 of FIG. 5 or all employed for a lower portion heating as shown for electrode 54 of FIG. 5, or a combination of any of these. For example, electrode 31 could extend for the full height 40 of reservoir 3, whereas electrode 32 could be employed for only the top portion heating as shown in FIG. 4, while electrode 33 could be employed for lower portion heating as shown for electrode 54 in FIG. 5.

Further, when a plurality of electrode wellbores and electrodes are employed in place of each of first electrode 21, second electrode 22, and third electrode 23, in each grouping of electrodes there can be a variation of length of electrode in the reservoir so that upper and lower or full height heating is obtained by using a plurality of different length electrodes for the first electrode, a plurality of different length electrodes for the second electrode and, a plurality of different length of electrodes for the third electrode. Thus, it can be seen that a very wide variety of spacings, alignments and configurations can be employed and the advantages of this invention still achieved. It can also be readily seen now that by following the principles of this invention, injection and production wellbore costs could be reduced considerably, because the electrode wellbore configurations can be very much simplified as opposed to employing an electrode in the injection or production wellbores themselves as shown in FIG. 1. Since the electrode wellbore can be essentially nothing more than a pipe inside a larger wellbore, the electrode wellbore completions can be inexpensive so that the overall electrode wellbore and injection and production wellbore costs can be less than the combination electrode/injection or production wellbore single completions of FIG. 1. Further, the simplicity of well design will permit easier wellbore workover for injection and production wellbores 2 and 4 and this will reduce the cost of continued operation of the electric heating operation. Also, steam formation around producing wellbore 4, if it occurs, can be better controlled since the electrode wellbore closest to producing wellbore 4 will be at a higher pressure. By having electrode wellbores intermediate the injection and production wellbores, the direction of electrical current flow can also be better regulated and this will help overcome reservoir inhomogenieties and other problems encountered in the reservoir which can cause distorted flow patterns. By placing both the injection and production wellbores at electrical ground potential and intermediate electrode wellbores at elevated electrical potential, power traps for both produced and injected fluids can be eliminated. This could not only reduce costs but improve safety aspects. With at least three electrode wellbores per injection production wellbore pair, total electrical power input could be significantly increased, which in turn could result in earlier and higher oil production rates. With significant heating occuring in the central region between the injection and production wellbores, a better sustained production rate will be realized, which is especially important in reservoirs which contain viscous oil.

The electric power employed in this invention can be direct current, pulsating direct current, or alternating current, although alternating is presently preferred for a number of reasons that would be obvious to those skilled in the art. The alternating current can be employed at any frequency although a frequency in the range of from about 1.5 to about 60 Hertz is preferred.

EXAMPLE

A wellbore configuration essentially the same as that shown in FIG. 4 is employed, wherein the electrode wellbores are each composed of a three and one half inch diameter wellbore which contains two inch diameter insulated cable connected to two inch diameter steel pipe which is set in reservoir 3 as the electrode itself. Injection and production wellbores 2 and 4 are spaced 1,000 feet from one another with first electrode wellbore 21 spaced essentially 500 feet from wellbores 2 and 4 and essentially, but not necessarily, in line with those wellbores. Electrode wellbores 22 and 23 are spaced 20 feet from injection wellbore 2 and production wellbore 4, respectively, and roughly in line with wellbores 2, 4, and 21, although straight-line alignment is not required. The electrodes extend into reservoir 3 for the upper half of its height 40 as shown in FIG. 4.

Electricity by way of generator 6 and in the form of 60 Hertz alternating current between 50 to 100 volts and 1500 amps is imposed between electrode pairs 31, 32 and 31–33 for 700 24-hour days. Thereafter, electric heating is terminated and steam is injected into reservoir 3 by way of wellbore 2 to produce the electrically heated oil in reservoir 3 between wellbores 2 and 4 to the earth's surface by way of production wellbore 4.

Reasonable variations and modifications are possible within the scope of this disclosure without departing from the spirit and scope of this invention.

I claim:

1. In a method for enchancing the production of hydrocarbonaceous fluid from a subterranean geologic reservoir containing same by electrical heating of said fluid and reservoir between an injection wellbore and a production wellbore, the improvement comprising employing at least one first electrode in said reservoir intermediate said injection and production wellbores, employing at least one second electrode in said reservoir intermediate said injection wellbore and said at least one first electrode, employing at least one third electrode in said reservoir intermediate said production wellbore and said at least one first electrode establishing said at least one first electrode at an electrical potential which is higher than the electrical potential of said at least one second and third electrodes, passing electrical current between said first electrode wellbore on the one hand and said second and third electrodes on the other hand to thereby heat said fluid and reservoir between said second and third electrodes.

2. The method of claim 1 wherein said at least one first electrode is spaced away from said injection and production wellbores a distance at least as great as about one-third of the total distance between said injection and production wellbores, said at least one second and third electrodes are spaced away from said injection and production wellbores a finite distance but no greater than about one-fourth of the total distance between said injection and production wellbores.

3. The method of claim 2 wherein said at least one second and third electrodes are each spaced away from said injection and production wellbores, respectively, by a distance of at least about ten feet.

4. The method of claim 1 wherein said first, second, and third electrodes are located in said reservoir so as to heat essentially the entire height of said reservoir.

5. The method of claim 1 wherein said first, second, and third electrodes are located in said reservoir so as to heat one of an upper portion of said reservoir or a lower portion of said reservoir.

6. In an apparatus for electrically heating a subterranean geologic reservoir between an injection wellbore and a production wellbore, the improvement comprising at least one first electrode in said reservoir intermediate said injection and production wellbores, at least one second electrode in said reservoir intermediate said injection wellbore and said at least one first electrode, at least one third electrode in said reservoir intermediate said production wellbore and said at least one first electrode, means for generating an electrical potential, and means for passing electrical current from said at least one first electrode to both said second and third electrodes.

7. The apparatus of claim 6 wherein said at least one first electrode is spaced away from said injection and production wellbores a distance at least as great as about one-third of the total distance between said injection and production wellbores, said at least one second and third electrodes are spaced away from said injection and production wellbores a finite distance but no greater than about one-fourth of the total distance between said injection and production wellbores.

8. The apparatus of claim 7 wherein said at least one second and third electrodes are each spaced away from said injection and production wellbores respectively, by a distance of at least about ten feet.

9. The apparatus of claim 6 wherein said first, second, and third electrodes are located in said reservoir so as to heat essentially the entire height of said reservoir.

10. The apparatus of claim 6 wherein said first, second, and third electrode are located in said reservoir so as to heat one of an upper portion of said reservoir or a lower portion of said reservoir.

* * * * *